United States Patent [19]

Stephenson

[11] 4,386,452

[45] Jun. 7, 1983

[54] ADJUSTABLE SELF-LOCKING TONGUE PLATE FOR SEAT BELTS

[75] Inventor: Robert L. Stephenson, Utica, Mich.

[73] Assignee: Allied Corporation, Morris Township, Morris County, N.J.

[21] Appl. No.: 166,503

[22] Filed: Jul. 7, 1980

[51] Int. Cl.[3] ..... A44B 11/10

[52] U.S. Cl. ..... 24/196; 24/171

[58] Field of Search ..... 24/194, 196, 197, 200, 24/171

[56] References Cited

U.S. PATENT DOCUMENTS

| | | | |
|---|---|---|---|
| 3,157,929 | 11/1964 | Warner et al. | 24/196 |
| 3,601,754 | 8/1971 | Filson | 339/256 SP |
| 3,974,546 | 8/1976 | Walker | 24/196 |
| 3,975,800 | 8/1976 | Farlind | 24/196 |
| 4,184,234 | 1/1980 | Anthony et al. | 24/196 |
| 4,219,236 | 8/1980 | Takada | 24/196 |

FOREIGN PATENT DOCUMENTS

| | | | |
|---|---|---|---|
| 1065200 | 9/1959 | Fed. Rep. of Germany | 24/196 |

*Primary Examiner*—Robert A. Hafer

*Attorney, Agent, or Firm*—Roger H. Criss; Robert H. Johnson

[57] ABSTRACT

An improved self-locking adjust tongue plate including a sleeve surrounding a lock bar extending in slots provided on side flanges of the tongue. The sleeve spaces the lock bar from the walls of the slots so as to avoid metal to metal contact, which may adversely affect the lock-up angles of the adjust tongue.

10 Claims, 7 Drawing Figures

ADJUSTABLE SELF-LOCKING TONGUE PLATE FOR SEAT BELTS

DESCRIPTION

BACKGROUND OF THE INVENTION

1. Field of the Invention

This invention relates to improved self-locking adjust tongues for seat belt buckle assemblies.

2. Description of the Prior Art

In vehicles equipped with active seat belt systems, self-locking adjust tongues are commonly used. Center seats are frequently equipped with static lap belts, and, after buckling, these systems require the occupant to pull the loose end of the webbing exiting the adjust tongue to provide a snug fit about the pelvic region. The adjust tongue must be capable of preventing the loose end of the webbing from slipping in order to provide occupant protection under crash load conditions. Government regulations require that lock-up occur when specific angles between the ingressing webbing and the bottom of the tongue are experienced (e.g., at a minimum angle of 30°). Conventional adjust tongues include a bar slidable in slots in laterally upstanding flanges, with the webbing being wrapped around the bar.

Continuous loop seat belt systems including retractors provided with tension eliminators are commonly used in the front outboard positions in U.S. vehicles. Adjust tongues are again an essential part of such systems. The tongue must be capable of sliding on the belt to provide proper fit to the occupant but must lock (that is disallow slippage of the webbing over the bar) under crash conditions to prevent any slack in the shoulder belt webbing from transferring to the lap belt.

Because of the critical nature of the lock-up angle, much care must be taken in maintaining smooth surfaces of the bar and slot interfaces. If the surfaces are not consistently smooth, inconsistent lock-up angles can be experienced. This is a difficult situation in such mass produced products and presently requires high tolerances and costly surface finishes. It would be desirable to provide consistent lock-up angles on these mass produced parts without the need to control the surface finish between the bar and the slots.

SUMMARY OF THE INVENTION

In accordance with this invention, there is provided an adjustable self-locking tongue plate useful in a seat belt buckle assembly, the tongue plate comprising:

- a base portion having an opening therein adapted to receive seat belt webbing therethrough;
- laterally spaced side flanges extending upwardly from the base portion and surrounding the opening;
- a slotted opening provided in each of the side flanges, the slotted openings being defined by a pair of relatively long upper and lower walls and a pair of shorter side walls;
- a lock bar slidably mounted in the slotted openings and extending across the opening in the base, the lock bar adapted to receive seat belt webbing thereabout; and
- spacing means in communication with the lock bar and normally effective to space the lock bar from the lower wall of the slotted openings while permitting the lock bar to freely slide within the slotted openings without resting on the lower wall;

Preferably, the spacing means is in the form of a plastic sleeve which surrounds the lock bar and includes wing-type flanges that ride on the inner surface of the base portion.

The present invention thus provides an improved self-locking adjust tongue in which the lock-up angles can be very carefully controlled in an economical manner.

DESCRIPTION OF THE PREFERRED EMBODIMENT

Figure 1:
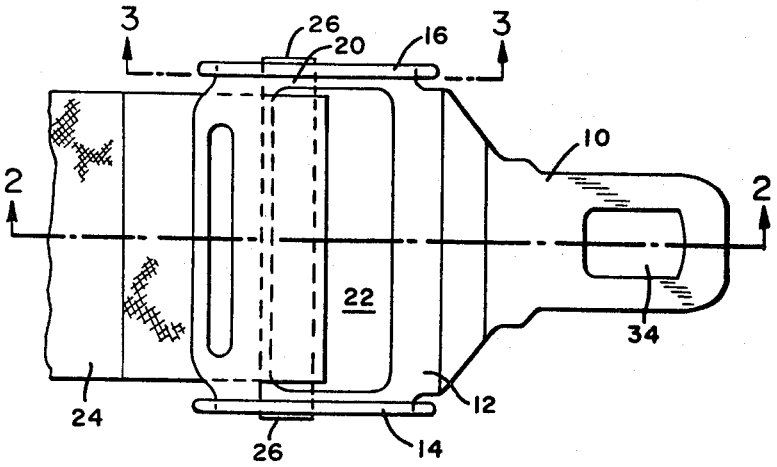
FIG. 1 (PRIOR ART)
FIG. 1 is a plan view of an existing adjust tongue.
Figure 2:
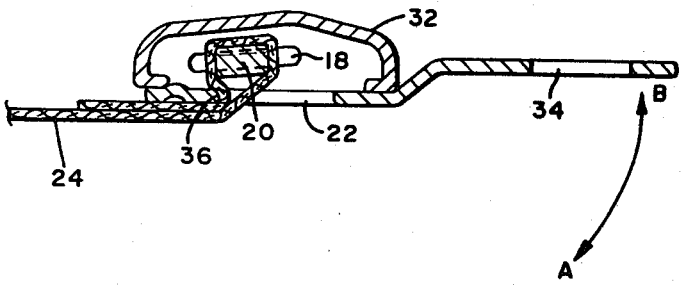
FIG. 2 (PRIOR ART)
FIG. 2 is a cross-section view of the tongue of FIG. 1 taken along line 2—2.
Figure 3:
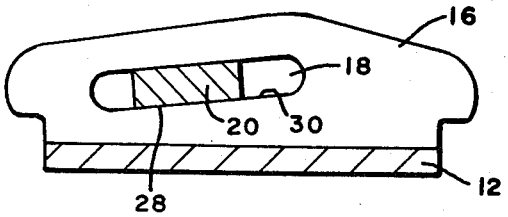
FIG. 3 (PRIOR ART)
FIG. 3 is a cross-section view of the tongue of FIG. 1 taken along line 3—3.

With reference to FIGS. 1–3 there is shown one form of a commercial prior art adjust tongue 10 having a base portion 12 and upstanding side flanges 14, 16, each provided with a generally inclined slot 18 in which a generally rectilinear lock bar 20 is slidably mounted. Base 12 includes an opening 22 for receiving seat belt webbing 24, which is wrapped around lock bar 20 and with its free end sewn back to the main portion of the webbing in a conventional manner. The other end of webbing 24 is connected to a retractor or seat belt anchor (not shown). The ends 26 of lock bar 20 have a reduced thickness when compared with the thickness of the central portion of the lock bar and their bottom edges (FIG. 3) are adapted to slide along surface 30 of openings 18 to permit adjustment of the webbing. Cover 32 is snap fitted over flanges 14, 16 to protect the assembly and provide a decorative cover. The forward end of base 12 is provided with an opening 34 which is adapted to receive a latch of a mating seat belt buckle (not shown).

Webbing 24 may freely slide about bar 20 when tongue 10 is tipped in the direction of arrow A. When tongue 10 is tipped in the direction of arrow B, bar 20 is urged to a rearward position in slots 18 (as shown) at which webbing 24 is pinched between bar 20 and the back edge of opening 22 at point 36, thereby preventing webbing 24 from moving through tongue 10. The disadvantages of such a prior art device have been described previously.

In accordance with this invention, as shown in FIGS. 4–7, there is provided an adjust tongue generally indicated at 100 formed of a metallic material and having a base portion 102 and integral upstanding side flanges 104, 106 each provided with a slotted opening 108 extending generally parallel to the major plane of tongue plate 100. Lock bar 110 is slidably mounted in slots 108 and has a generally rectilinear shape (without reduced thickness at the end portions as compared with the lock bar 20 of FIGS. 1–3).

Provided over the top, front edge and bottom of bar 110 is a plastic sleeve 112 having integral wing-type flanges 114, 116 that are in contact with and ride upon side portions 118, 120 of base portion 102 adjacent to opening 122 for receiving seat belt webbing 124. Seat belt webbing 124 extends around sleeve 112 and lock bar 110 and is stitched or otherwise fastened to itself as in the prior art embodiment. Likewise, the opposite end of seat belt webbing 124 is attached to a retractor or an anchor (not shown). A cover 126 is snap fitted over base portion 102 and an opening 128 is provided at the forward end of tongue 100 for engagement by a latch of a seat belt buckle, as described previously. Sleeve 112, which may be formed of nylon, may be provided if desired with a roughened surface 130 adjacent to the lower half of its front portion which serves to engage seat belt 124 and slow its motion through tongue 100 in the event of a force acting on the belt by virtue of occupant motion thereagainst such as may occur in the event of a collision. Tongue 100 is typically plated with chrome and hence the surface of base portion 102 is inherently smooth.

Figure 6:
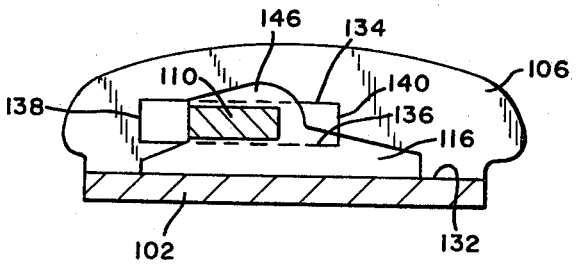
FIG. 6 is a cross-section view of the tongue of FIG. 4 taken along line 6—6.
Figure 7:
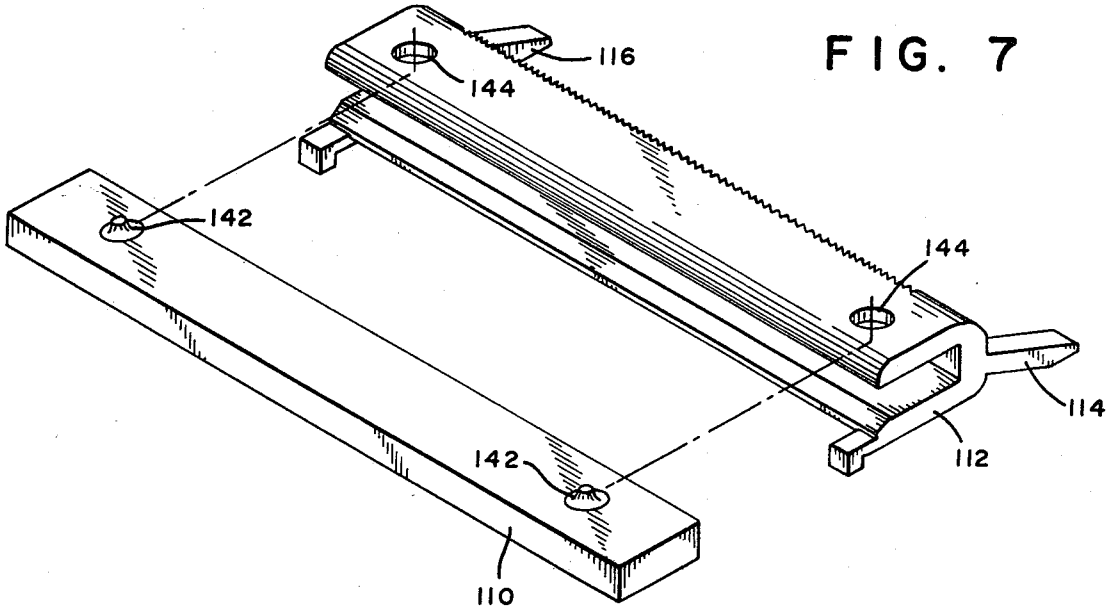
FIG. 7 is an exploded perspective view of the lock bar and sleeve of the adjust tongue of this invention.

With specific reference to FIG. 6, it can be seen that lock bar 110 is slidable within slots 108 by virtue of the sliding contact of the underside portions of wing-type flanges 114, 116 of sleeve 112 with the upper smooth surface 132 of side portions 118, 120 of base 102. Slots 108 are in the form of generally rectangular openings having upper and lower walls 134, 136 extending generally parallel to the major plane of tongue plate 100 and sidewalls 138, 140, which are shorter than the upper and lower walls and which extend generally perpendicular to the upper and lower walls. Sleeve 112 acts as the spacing means which prevents metal to metal contact of the ends of lock bar 110 with at least the lower walls 136 of slots 108, and preferably the upper walls 134 as well, as lock bar 110 slides within slots 108. Lock bar 110 thus does not rest on lower wall 136 so that the tolerances and surface quality of lock bar 110, slots 108 and wall 136 need not be extremely high.

Preferably, sleeve 112 is snap fitted over lock bar 110. In order to assist in the retention of sleeve 112 on bar 110, bar 110 may be provided with upstanding lugs 142 which mate with aligned openings 144 in the upper surface 146 of sleeve 112. Alternatively, the lugs may be provided on sleeve 112 and the openings or depressions in lock bar 110.

Figure 4:
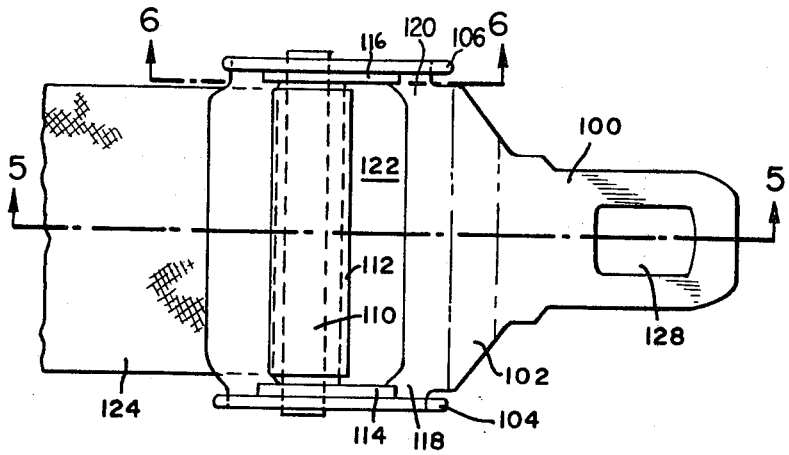
FIG. 4 is a plan view of the adjust tongue of this invention.
Figure 5:
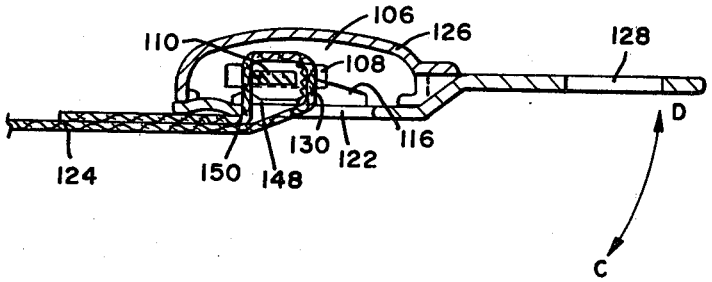
FIG. 5 is a cross-section view of the tongue of FIG. 4 taken along lines 5—5.

In operation, webbing 124 may freely slide about sleeve 112 (and hence bar 110) when the seat belt is being adjusted as long as tongue 100 is tipped in the direction of arrow C (FIG. 4). When the tongue is tipped in the opposite direction (arrow D), sleeve 112 and lock bar 110 are urged rearwardly in slots 108, with flanges 114, 116 riding smoothly on base 102, to a position shown in the drawings. At such rearward position, webbing 124 is pinched between the rearward underside surface 148 of sleeve 112 and the back edge of opening 122 at 150. Webbing 124 is thus prevented from moving through adjust tongue 100.

In the event of a force exerted by an occupant against webbing 124 as a result, for example, of a collision force, bar 110 is forced into contact with the walls of slots 108 so that the loads are transferred from bar 110 to side flanges 104, 106 of the tongue plate. The plastic nature of sleeve 112 permits flexing so that bar 110 may contact the walls of the slot 108 in such an event, or, alternatively, sleeve 112 is designed to fracture at a much lower force than the breaking strength of metal bar 110 so that such load transfer may be achieved.

It can be seen that the present invention provides an economical and simple manner of assuring that the proper angular relationship between the lock bar and the adjust tongue is established so that lock-up angles are very carefully controlled.

It is to be understood that variations and modifications of the present invention may be made without departing from the scope thereof. It is also to be understood that the present invention is not to be limited by the specific embodiments disclosed herein but only in accordance with the appended claims when read in light of the foregoing specification.

What is claimed is:

1. An adjustable self-locking tongue plate useful in a seat belt buckle assembly, said tongue plate comprising:

a base portion having an opening therein adapted to receive seat belt webbing therethrough;

laterally spaced side flanges extending upwardly from said base portion and surrounding said opening;

a slotted opening provided in each of said side flanges, said slotted openings being defined by a pair of relatively long upper and lower walls and a pair of shorter side walls;

a lock bar slidably mounted in said slotted openings and extending across said opening in said base, said lock bar adapted to receive seat belt webbing thereabout; and spacing means operatively connected to said lock bar and normally effective to space said lock bar from said lower walls of said slotted openings and permitting said lock bar to freely slide within said slotted openings without resting on said lower walls.

2. The tongue plate of claim 1 wherein said spacing means comprises a sleeve at least partially surrounding said lock bar.

3. The tongue plate of claim 2 wherein said spacing means includes wing sections slidable on said base portion on the opposite sides of said opening in said base portion.

4. The tongue plate of claim 3 wherein said sleeve is formed of a plastic material.

5. The tongue plate of claim 4 including a roughened surface on said sleeve for limiting movement of said seat belt webbing thereabout.

6. The tongue plate of claim 2 including retaining means provided on said lock bar and engagable in interlocking relationship with retaining means provided on said sleeve to retain said sleeve on said lock bar.

7. The tongue plate of claim 6 wherein said retaining means on said lock bar comprises at least one upstanding protrusion, and said retaining means on said sleeve comprises at least one opening surrounding said protrusion.

8. The tongue plate of claim 1 wherein said base plate is defined by a major longitudinally extending plane and said upper and lower walls of said slotted openings are substantially parallel to said major plane.

9. The tongue plate of claim 1 wherein said side flanges comprise integral upturned side portions of said base portion.

10. The tongue plate of claim 1 including a second opening in said base portion adapted to cooperate with a locking member of said buckle assembly.

* * * * *